United States Patent [19]

Kamohara et al.

[11] 4,262,517

[45] Apr. 21, 1981

[54] METHOD OF CORRECTING DISTORTED PIPE END

[75] Inventors: Hideaki Kamohara; Yuji Yoshitomi, both of Kudamatsu; Takaichi Koyama; Yasumasa Tamai, both of Hitachi, all of Japan

[73] Assignee: Hitachi, Ltd., Tokyo, Japan

[21] Appl. No.: 63,449

[22] Filed: Aug. 3, 1979

[30] Foreign Application Priority Data

Aug. 7, 1978 [JP] Japan ..... 53-95468

[51] Int. Cl.[3] ..... B21D 47/02; B21C 3/12

[52] U.S. Cl. ..... 72/370; 72/393

[58] Field of Search ..... 72/54, 58, 61, 62, 370, 72/393

[56] References Cited

U.S. PATENT DOCUMENTS

| | | | |
|---|---|---|---|
| 3,016,856 | 1/1962 | Cummings | 72/393 X |
| 3,362,603 | 1/1968 | Bauer et al. | 72/393 X |
| 3,581,546 | 6/1971 | Ragettli | 72/370 |

FOREIGN PATENT DOCUMENTS

| | | | |
|---|---|---|---|
| 53-47094 | of 1978 | Japan | 72/370 |
| 1225775 | 3/1971 | United Kingdom | 72/58 |

*Primary Examiner*—Lowell A. Larson
*Attorney, Agent, or Firm*—Craig & Antonelli

[57] ABSTRACT

In a method of correcting a distorted pipe end to an original substantially true circular cross-section, external loads are applied to the outer peripheral surface of the pipe adjacent to the end thereof to forcibly deform the pipe end to the substantially true circular cross-section. The external loads are maintained to keep this substantially true circular cross-sectional shape while an internal pressure is applied to the inner peripheral surface of the pipe end until a circumferential stress produced in the pipe reaches an amount which exceeds the yield stress of the pipe to give a radial permanent deformation to the pipe for thereby producing a circumferentially uniformly distributed residual stress in the pipe.

5 Claims, 13 Drawing Figures

METHOD OF CORRECTING DISTORTED PIPE END

BACKGROUND OF THE INVENTION

1. Field of the Invention

The present invention relates to a method of correcting the shape of a distorted end of a pipe and, more particularly, to a method of correcting a distorted pipe end to the original substantially true circular cross-section by applying radially inward external loads to the outer peripheral surface of the pipe end and also applying a radially outward internal pressure to the inner peripheral surface of the pipe end.

2. Description of the Prior Art

Generally, in the construction of chemical plants, power plants and the like, pipe lines interconnecting various apparatus and equipments are worked or made at the construction site by coupling or connecting pipes usually by welding. So as to obtain a good weld, it is necessary that the cross-sectional shapes of the ends of two pipes to be welded together conform each other because, if the pipe ends to be welded together have different cross-sectional shapes, the weldability is lowered to impair the mechanical strength and corrosion-resistant property of the weld, resulting in a poor reliability of the welded pipe lines.

The prior art problems will be discussed in more detail with reference to FIGS. 1 to 4.

FIG. 1 shows two straight pipe elements 1 and 2 to be welded together. The pipe element 1 has previously been connected with a branch pipe 3 by welding 5. The end 4 of the pipe element 1 to be welded to the pipe element 2 has been deformed or distorted to an oval cross-section as shown in FIG. 2A due to the thermal deformation caused by the heat input. On the other hand, the end of the other pipe element 2 to be welded to the pipe end 4 of the pipe element 1 presents a substantially true circular cross-section because no branch pipe has been welded to the pipe element 2. If the pipe element 1 is welded at its end 4 to the circular end of the pipe element 2 simply by a single-side welding effected from the outside only, it is impossible to obtain a good weld joint 5*a* having a good penetration bead 6 as shown in FIG. 3.

To avoid this problem, the shape of the distorted end 4 of the pipe element 1 is corrected to the original circular shape before the pipe end is welded to a mating pipe element. FIG. 4 shows an example of the conventional method of correcting distorted pipe ends. According to this method, a plurality of L-shaped legs 7 are welded to the outer peripheral surface of a pipe element 1 at a suitable circumferential pitch. A correction bolt 8 is screwed into free end of each leg 7. As these correction bolts 8 are screwed, the inner ends of these bolts abut and press the end 4 of the pipe element 1 radially inwardly. The distorted pipe end 4 of the pipe element 1 is thus corrected by the application of radial loads P to resume the original true circular cross-section. The legs 7 are removed after the completion of the correction. This typical conventional correction method, however, cannot provide a uniform correction over the entire periphery of the pipe end because the radial loads P are concentrated to circumferentially spaced points on the pipe end. In addition, since the legs 7 are secured to the pipe element 1 by welding, the residual welding stress remains even after the removal of the legs to adversely affect the corrosion-resistant and other properties of the pipes. It is also to be pointed out that this conventional correction method takes an impractically long time.

SUMMARY OF THE INVENTION

It is therefore an object of the present invention to provide an improved method of correcting a distorted pipe end which can eliminate the prior art problems and shortcomings discussed above.

It is another object of the present invention to provide an improved method of correcting a distorted pipe end in which external loads and internal pressure are applied to the outer and inner peripheral surfaces of the pipe end to cause a minute or slight radial deformation in the pipe end to thereby distribute the residual stress uniformly in the circumferential direction thereof.

According to the present invention, there is provided a method of correcting a distorted end of a pipe to an original substantially true circular cross-section, the method comprising the steps of: applying, in at least two radial directions, external loads to the outer peripheral surface of the pipe adjacent to the end thereof to elastically and plastically deform the pipe end to a substantially true circular cross-section; maintaining this substantially true circular cross-section while applying an internal pressure to the inner peripheral surface of the pipe adjacent to the end thereof until a circumferential stress produced in the pipe adjacent to the end is increased up to a value which is at least equal to the yield stress of the pipe; and thereafter removing the internal pressure.

The above and other objects, features and advantages of the present invention will be made more apparent by the following description with reference to the accompanying drawings.

DESCRIPTION OF A PREFERRED EMBODIMENT

Figure 5:
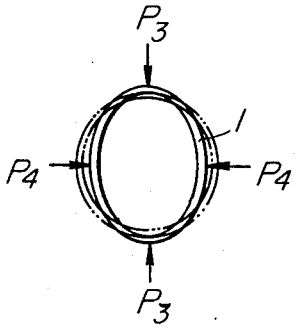
FIGS. 5 and 6 diagrammatically illustrate the principle of the method of correcting a distorted pipe end according to the present invention.

The principle of the method of correcting a pipe end will be described with reference to FIGS. 5 and 6 of the accompanying drawings. According to the present invention, radially inward external loads are applied in at least two radial directions to the outer peripheral surface of a deformed or distorted end of a pipe element 1, as shown by arrows $P_3$ and $P_4$, by means of hydraulic cylinders (not shown in FIGS. 5 and 6), so that the pipe end is elastically and plastically deformed from the initial non-circular shape shown by the solid lines to a substantially true circular shape shown by the broken lines. It will be noted that, if the external loads $P_3$ and $P_4$ are removed, the pipe end will exhibit a non-circular cross-section because the part of the deformation caused by the elastic deformation tends to recover the pipe end towards the original non-circular shape.

The radially inward external loads may preferably be applied to the pipe end over an area which ranges from 50 to 150% of the area over which the pipe is to be corrected in cross-sectional shape.

Figure 6:
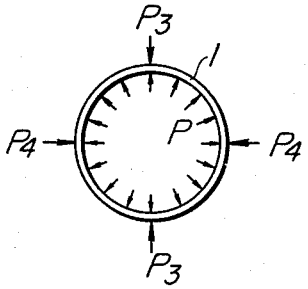
Figure 7:
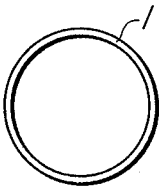
FIG. 7 illustrates the cross-sectional shape of a pipe end corrected by the method of the invention.

Then, a radially outward internal pressure P is applied to the inner peripheral surface of the pipe end, as shown in FIG. 6, while forcibly maintaining the substantially circular cross-section by the external loads $P_3$ and $P_4$. The internal pressure P will be increased stepwise; namely, the internal pressure P will be first increased until the circumferential stress in the pipe 1 reaches about 100 to 120% of the yield stress of the pipe. When this state is reached, the external loads $P_3$ and $P_4$ will be removed. Then, the internal pressure P will be further increased until the circumferential stress in the pipe 1 reaches 110 to 200% of the yield stress of the pipe. When this state is attained, the internal pressure P will be removed. The application of the external loads and internal pressure in the manner discussed assures that the distorted end of the pipe 1 is corrected to a substantially true circular shape, as shown in FIG. 7.

Preferably, the region of the pipe 1 over which the internal pressure P is applied to the pipe coincides with the region of the pipe 1 where the pipe is corrected in cross-sectional shape.

As described, the novel method according to the present invention applies the internal pressure P until the circumferential stress in the pipe exceeds the yield stress of the pipe while the pipe end is forcibly maintained in a substantially true circular shape by the application of radially inward external loads $P_3$ and $P_4$. As a result, a slight radial permanent deformation is produced in the pipe end to extinguish the circumferentially uneven stress distribution which exists in the pipe before the application of the internal pressure. Thus, on removal of the internal pressure P from the pipe 1, a circumferentially uniform residual stress is produced in the pipe to ensure a substantially true circular cross-section of the corrected pipe end.

In the case where an internal pressure is applied to the inner peripheral surface of a pipe end without applying external loads to the pipe end in an attempt to correct the same to a circular shape, as in the prior art method carried out by a pipe expanding and correcting apparatus disclosed in Japanese Utility Model Publication No. 53-47094 (47094/1978), the internal pressure is applied to the pipe end while it is in non-circular state. This prior art method, therefore, does not assure a reliable correction of the non-circular shape of the pipe end into a substantially true circular shape.

Figure 1:
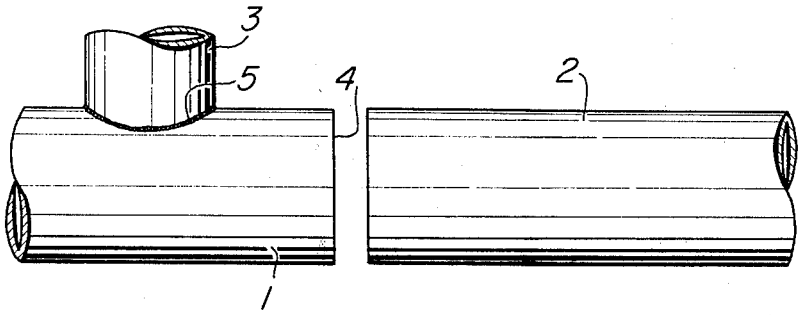
FIG. 1 PRIOR ART
FIG. 1 is a diagrammatic side view of a first pipe element having a distorted end to be corrected and a second pipe element to be welded to the first pipe element.
Figure 2A:
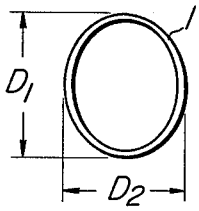
FIG. 2A PRIOR ART
FIG. 2A is an end view of the distorted end of the first pipe element shown in FIG. 1.
Figure 2B:
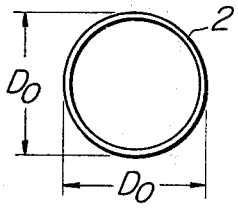
FIG. 2B PRIOR ART
FIG. 2B is an end view of the non-distorted end of the second pipe element shown in FIG. 1.
Figure 3:
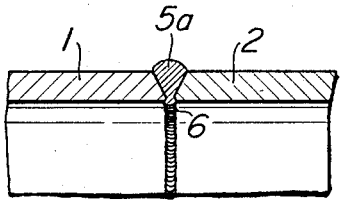
FIG. 3 PRIOR ART
FIG. 3 is a fragmentary axial sectional view of the welded ends of the first and second pipe elements showing the weld joint in detail.
Figure 4A:
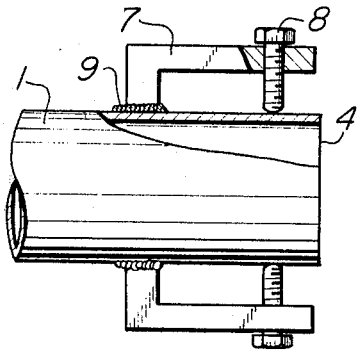
FIG. 4A PRIOR ART
FIG. 4A is a schematic illustration of a prior art method of correcting a distorted pipe end.
Figure 4B:
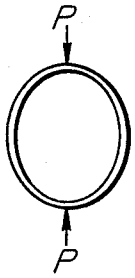
FIG. 4B PRIOR ART
FIG. 4B is an end view of the distorted pipe end to be corrected by the method shown in FIG. 4A.

Also, in the case of the prior art discussed in conjunction with FIG. 4, external loads only are applied to a distorted pipe end in an attempt to forcibly correct the pipe end to a substantially true circular shape, with a result that the circumferentially uneven stress cannot be re-distributed uniformly in the circumferential direction. On removal of the external pressures, therefore, the forcibly corrected pipe end again resumes its intitial non-circular shape.

In contrast, the present invention applies external loads to the outer surface of a pipe end for temporal correction of the shape thereof and also applies a uniform internal pressure to the inner peripheral surface of the pipe end to produce a slight radial permanent deformation in the pipe to assure a circumferentially uniform distribution of the residual stress for thereby facilitating a reliable correction of the distorted pipe end.

In practically carrying out the method of the invention, the external loads can be applied mechanically by means of hydraulic cylinders, screws or the like, while the internal pressure can be applied hydraulically, pneumatically or by means of an elastic member which expands radially when compressed in the axial direction.

Figure 8:
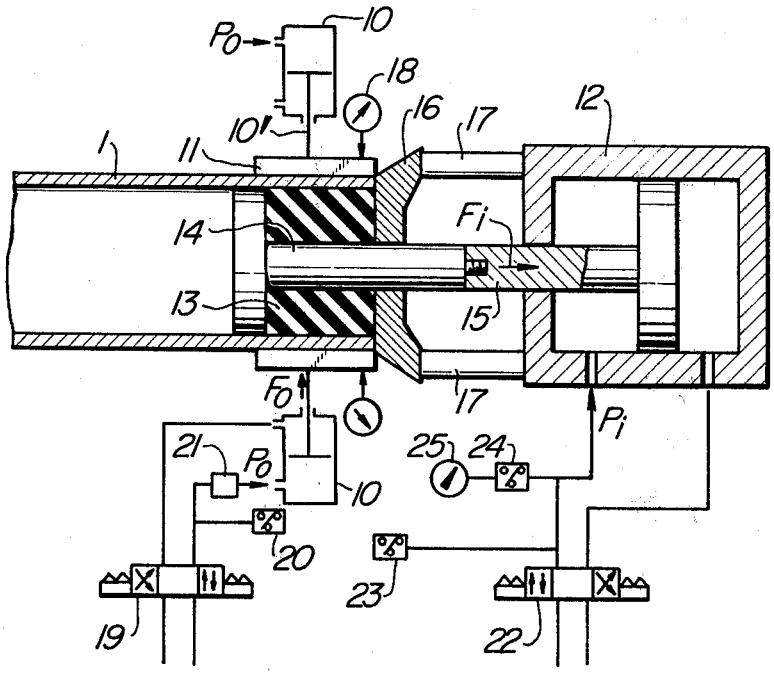
FIG. 8 is a partly sectional diagrammatic illustration of an apparatus used to carry out the method of the present invention.

A practical example of the method will be described hereinunder with reference to FIG. 8 showing an example of the apparatus which is suitable for use in carrying out the method of the invention.

Referring to FIG. 8, the apparatus has hydraulic cylinders 10 disposed around the end of a pipe 1 to be corrected. The cylinders 10 have piston rods 10' which are adapted to impart radially inward external loads through pads 11 to the outer peripheral surface of the pipe end. A generally T-shaped pressurizing rod 14 with an elastically deformable element 13 mounted thereon is inserted into the pipe end to be corrected. The stem of the rod 14 extends out of the pipe end through a back-up ring 16 which is disposed in abutment contact with the end face of the pipe end. The outer end of the stem of the rod 14 is fixedly connected to an outer end of a piston rod 15 of a hydraulic cylinder 12. The back-up ring 16 and the cylinder 12 are held in axially spaced position by means of spacer rods 17 extending therebetween. Displacement gauges 18 are disposed on the pads 11 to detect radial displacements of the pads and thus the radial deformation of the pipe end.

In operation, a hydraulic fluid delivered from a hydraulic pump (not shown) and flowing through a pressure regulation valve (not shown) passes through a solenoid valve 19 and an electro-magnetically operated valve 21 into the cylinders 10 to radially inwardly urge the piston rods 10' against the pads 11 so that radially inward external loads $F_o$ are applied to the outer peripheral surface of the end of the pipe 1. The deformation of the pipe end is detected by means of the displacement gauges 18. The amount of the deformation is adjusted to assure that the deformed end of the pipe 1 is kept in substantially true circular shape. When the hydraulic pressure reaches a predetermined pressure level $P_o$, contacts of a pressure sensitive switch 20 are closed to close the electro-magnetically operated valve 21 so that the external loads are maintained on the outer peripheral surface of the pipe end. Then, the head of the pressurizing rod 14 and the elastically deformable element 13 are inserted into the pipe end. The buck-up ring 16, the cylinder 12 and the spacer rods 17 are set in position as shown in FIG. 8. A solenoid valve 22 is then operated to introduce a hydraulic fluid under a high pressure into the cylinder 12 so that the piston 15 is moved to the right as viewed in FIG. 8 to exert a force $F_l$ to the rod 14 to axially move the same rightwards. The elastically deformable element 13 is axially inwardly supported by the buck-up ring 16 and thus is pressed in the axial direction so that the element 13 is radially outwardly deformed or expanded to apply a radially outward internal pressure to the inner peripheral surface of the pipe end whereby the pipe is radially outwardly expanded. When the hydraulic pressure applied to the cylinder 12 reaches a pressure level which is high enough to produce in the pipe 1 a circumferential stress of an amount equal to 100 to 120% of the yield stress of the pipe 1, contacts of a pressure sensitive switch 23 are operated to open the electro-magnetically operated valve 21 and to operate the solenoid valve 19 so that the pressure in the cylinders 10 is lowered. The hydraulic pressure in the cylinder 12 is further increased up to a predetermined pressure level $P_l$ which is high enough to produce in the pipe 1 a circumferential stress of a magnitude equal to 110 to 200% of the yield stress of the pipe. When this pressure level $P_l$ is reached, contacts of pressure responsive switch 24 are operated to actuate a timer 25 which is set to maintain the pressure level $P_l$ for a predetermined time period $t_o$. Then, after the lapse of the time period $t_o$, the timer 25 actuates the solenoid valve 22 so that the hydraulic pressure is relieased from the hydraulic cylinder 12 to complete the correction of the shape of the end of the pipe 1.

As described, the internal pressure is applied uniformly to the inner peripheral surface of the pipe end while the external loads are applied to several points on the outer peripheral surface of the pipe end. The internal pressure is increased until the circumferential stress produced in the pipe amounts to a value which is equal to 100 to 120% of the yield stress of the pipe. When this condition is obtained, the pressure $P_o$ applied to the hydraulic cylinders 10 is released and, simultaneously, the hydraulic pressure in the cylinder 12 is further increased to increase the axial force $F_l$ until the circumferential stress produced in the pipe 1 is increased to a value which is equal to 110 to 200% of the yield stress of the pipe. This condition is maintained for a predetermined time period and, thereafter, the internal pressure is removed from the pipe end. As a result, the residual stress in the pipe is circumferentially uniformly distributed to assure a reliable correction of the cross-sectional shape of the pipe end.

Figure 9:
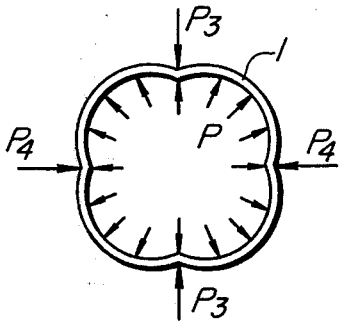
FIG. 9 illustrates the cross-sectional shape of a pipe end which has resulted from the application of internal pressure to the inner surface of the pipe end without removing external loads from the outer periphery of the pipe end.

The reason why the hydraulic pressure $P_o$ and thus the external loads $P_3$ and $P_4$ are released during the application of the internal pressure to the pipe end is because, if the internal pressure P is increased while maintaining the external loads $P_3$ and $P_4$ on the outer peripheral surface of the pipe 1, the peripheral wall of the pipe 1 is irregularly expanded as shown in FIG. 9 and this irregular deformation cannot be removed even after the removal of the internal pressure from the pipe 1.

Figure 10:
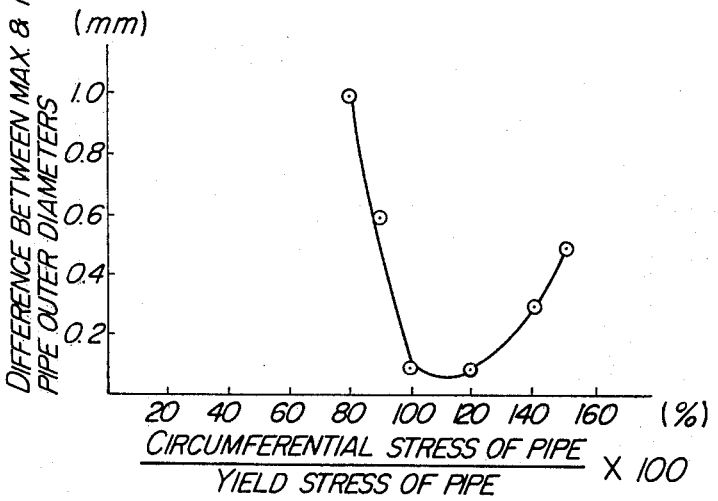
FIGS. 10 and 11 graphically illustrate results of tests conducted to acknowledge advantages of the method of the present invention.

The reason why the hydraulic pressure $P_o$ in the cylinders 10 is released to remove the external loads $P_3$ and $P_4$ from the outer peripheral surface of the pipe 1 when the circumferential stress in the pipe has reached a value equal to 100 to 120% of the yield stress of the pipe is because the pipe 1 is in its elastic state when the circumferential stress is less than 100% of the yield stress and, thus, if the external loads $P_3$ and $P_4$ are removed when the pipe 1 is still in its elastic state, the pipe end resumes its initial distorted shape and cannot be corrected to a substantially true circular shape even if the internal pressure is increased after the removal of the external loads $P_3$ and $P_4$. On the other hand, if the external loads $P_3$ and $P_4$ are maintained until the circumferential stress in the pipe 1 exceeds 130% of the yield stress, the pipe end will be irregularly deformed to the shape shown in FIG. 9 and cannot be corrected to a substantially circular shape. A good understanding of this discussion will be obtained from FIG. 10 which graphically illustrates experimental data obtained from carbon steel pipes of 97.3 mm in diameter and 4.65 mm in thickness which have been expanded in various ways.

Figure 11:
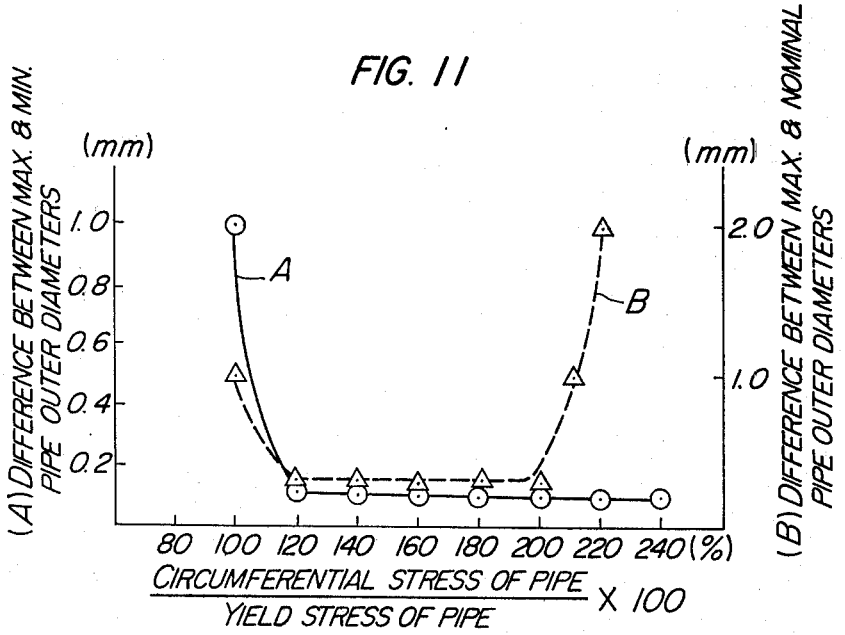

The reason why the internal pressure is maintained for a predetermined time at a pressure level which is high enough to produce in the pipe a circumferential stress equal to 110 to 200% of the yield stress of the pipe and thereafter the internal pressure is removed will be discussed in conjunction with FIG. 11 which graphically illustrates experimental data obtained from carbon steel pipes of 97.3 mm in diameter and 4.65 mm in thickness which have been expanded in various ways. As shown by the solid line curve A, the application of internal pressure which is not high enough to produce a circumferential stress greater than 110% of the yield stress failed to give sufficient plastic deformation to the pipes and thus could not correct the pipe ends to circular shape. On the other hand, the application of the internal pressure high enough to produce a circumferential stress greater than 200% of the yield stress could give a sufficient plastic deformation to the pipes and was successful to correct the pipe ends to circular shape, as shown by broken line curve B. In this case, however, the pipes were expanded to such an extent that the outer diameters of the expanded tubes were much larger than the nominal outer diameters of the pipes, which tends to result in the production of weld defects in subsequent connection of the expanded pipes to other pipes by welding.

The amount of deformation of a pipe in plastic state depends on the time period during which the internal pressure is maintained. This time period is preferably approximately 30 seconds.

The present invention assures a smooth correction of a distorted end of a pipe to an original substantially true circular shape. An adjacent pipe may also be similarly corrected so that the ends of the two pipes conform each other and thus can be connected together by a weld of a highly reliable and superior quality.

The present invention, therefore, is advantageous in that the application of internal pressure and external loads to a non-circular end of a pipe can correct the pipe end to a substantially true circular shape.

What is claimed is:

1. A method of correcting a distorted end of a pipe to an original substantially true circular cross-section, the method comprising the steps of: applying, in at least two radial directions, external loads to the outer peripheral surface of the pipe adjacent to said end to elastically and plastically deform said pipe end into a substantially true circular cross-section; maintaining this substantially true circular cross-section while applying an internal pressure to the inner peripheral surface of the pipe end until a circumferential stress produced in said pipe adjacent said end is increased up to a value which is at least equal to the yield stress of said pipe; and thereafter removing said internal pressure.

2. The pipe end correcting method according to claim 1, wherein said external loads are removed when the circumferential stress produced in said pipe by said internal pressure is increased to an amount equal to 100 to 120% of the yield stress of said pipe.

3. The pipe end correcting method according to claim 1, wherein said external loads are applied to the area of said pipe which is as large as from 50 to 150% of the area of the pipe end over which said pipe must be corrected in shape.

4. The pipe end correcting method according to claim 1, wherein said internal pressure is applied to the area of said pipe which substantially coincides with the area over which said pipe end must be corrected in shape.

5. The pipe end correcting method according to claim 1, wherein said internal pressure is high enough to increase the circumferential stress in said pipe to an amount which is equal to from 110 to 200% of the yield stress of said pipe.

* * * * *